US012635782B1

(12) United States Patent
Orr

(10) Patent No.: US 12,635,782 B1
(45) Date of Patent: May 26, 2026

(54) PERSONAL CARE PRODUCT APPLICATOR

(71) Applicant: Honestly Phresh, LLC, Prescott, AZ (US)

(72) Inventor: Hilary J. Orr, Prescott, AZ (US)

(73) Assignee: Honestly Phresh, LLC, Prescott, AZ (US)

( * ) Notice: Subject to any disclaimer, the term of this patent is extended or adjusted under 35 U.S.C. 154(b) by 266 days.

(21) Appl. No.: 18/139,893

(22) Filed: Apr. 26, 2023

Related U.S. Application Data

(60) Provisional application No. 63/335,099, filed on Apr. 26, 2022.

(51) Int. Cl.
*A45D 40/06* (2006.01)
*A45D 40/10* (2006.01)
*A45D 40/00* (2006.01)

(52) U.S. Cl.
CPC ..... *A45D 40/06* (2013.01); *A45D 40/10* (2013.01); *A45D 2040/0025* (2013.01)

(58) Field of Classification Search
CPC . A45D 40/04; A45D 40/10; A45D 2040/0025
USPC ..... 401/68, 75, 81
See application file for complete search history.

(56) References Cited

U.S. PATENT DOCUMENTS 1,764,452 A 6/1930 Janer
2,328,973 A 9/1943 Goldfisher
2,655,261 A * 10/1953 Clark ..... A45D 40/04 401/79
3,771,881 A 11/1973 Swenson
5,037,010 A * 8/1991 Dikstein ..... A45D 40/0075 222/405
2024/0306795 A1 9/2024 Hornfeck

OTHER PUBLICATIONS

Notice of Allowance dated Mar. 13, 2025 for U.S. Appl. No. 19/005,531 (pp. 1-9).
Notice of Allowance dated Mar. 20, 2025 for U.S. Appl. No. 19/005,531 (pp. 1-3).

* cited by examiner

*Primary Examiner* — Jennifer C Chiang
(74) *Attorney, Agent, or Firm* — Pacer K. Udall; Booth Udall, PLC

(57) ABSTRACT

A personal care product applicator with a hollow body, a cap, a base, and a lift. The cap is configured to couple with a top end of the body. The base is rotatably coupled to a bottom end of the body and has a top surface with a first anchor. The lift is positioned within the body and has a threaded outer surface that is configured to engage with a threaded inner surface of the body. The lift also has a bottom surface with a second anchor. The lift is rotatably fixed to the base through a spring attached to the first anchor and the second anchor. When the base is rotated in a first direction, the body raises the lift with respect to the body and when the base is rotated in a second direction, the body lowers the lift with respect to the body.

18 Claims, 12 Drawing Sheets

PERSONAL CARE PRODUCT APPLICATOR

CROSS REFERENCE TO RELATED APPLICATIONS

This application claims the benefit of the filing date of U.S. Provisional Patent Application 63/335,099 entitled "Aluminum Applicator" to Hilary J. Orr that was filed on Apr. 26, 2022, the disclosure of which is hereby incorporated herein by this reference.

TECHNICAL FIELD

Aspects of this document relate generally to an applicator, and more specifically to an applicator for personal care products.

BACKGROUND

It is important to some consumers of personal care products to use containers that are eco-friendly and recyclable. In addition, some consumers make their own personal care products and re-use the containers to hold the personal care products they make. The containers for personal care products currently available on the market are single-use disposable containers that do not fit the requirements of these consumers.

SUMMARY

Aspects of this document relate to an applicator comprising a hollow, cylindrical body extending between a top end and a bottom end, the body having a threaded inner surface, wherein an interior volume of the body is configured to hold a meltable solid, a cap configured to slidably couple with the top end of the body and enclose the interior volume, a base rotatably coupled to the bottom end of the body, the base having a top surface with a first anchor extending up from the top surface and a plurality of clips extending up from the top surface surrounding the first anchor, wherein the first anchor is configured to provide a secure attachment point to the base and the plurality of clips are configured to engage with the bottom end of the body to rotatably couple the base to the body, and a lift positioned within the body, the lift having a threaded outer surface configured to engage with the threaded inner surface of the body, the lift further having a bottom surface with a second anchor extending down from the bottom surface and configured to provide a secure attachment point to the lift, wherein the lift is rotatably fixed to the base through a spring with a first end of the spring attached to the first anchor and a second end of the spring attached to the second anchor, and wherein when the base is rotated with respect to the body, the lift rotates with the base, wherein, when the base is rotated in a first direction, the threaded outer surface of the lift engages with the threaded inner surface of the body to raise the lift with respect to the body and when the base is rotated in a second direction opposite the first direction, the threaded outer surface of the lift engages with the threaded inner surface of the body to lower the lift with respect to the body.

Particular embodiments may comprise one or more of the following features. The applicator may be manufactured from an aluminum material. The meltable solid may be a personal care product. The spring may be an accordion spring and may be configured to rotatably fix the lift to the base while allowing for a variable distance between the lift and the base.

Aspects of this document relate to an applicator comprising a hollow body extending between a top end and a bottom end, the body having a threaded inner surface, wherein an interior volume of the body is configured to hold a meltable solid, a cap configured to couple with the top end of the body and enclose the interior volume, a base rotatably coupled to the bottom end of the body, the base having a top surface with a first anchor extending up from the top surface, wherein the first anchor is configured to provide a secure attachment point to the base, and a lift positioned within the body, the lift having a threaded outer surface configured to engage with the threaded inner surface of the body, the lift further having a bottom surface with a second anchor extending down from the bottom surface configured to provide a secure attachment point to the lift, wherein the lift is rotatably fixed to the base through a spring with a first end of the spring attached to the first anchor and a second end of the spring attached to the second anchor, and wherein when the base is rotated with respect to the body, the lift rotates with the base, wherein, when the base is rotated in a first direction, the threaded outer surface of the lift engages with the threaded inner surface of the body to raise the lift with respect to the body and when the base is rotated in a second direction opposite the first direction, the threaded outer surface of the lift engages with the threaded inner surface of the body to lower the lift with respect to the body.

Particular embodiments may comprise one or more of the following features. The cap may be configured to slidably couple with the top end of the body. The base may further have a plurality of clips extending up from the top surface and surrounding the first anchor, the plurality of clips configured to engage with the bottom end of the body to rotatably couple the base to the body. The applicator may be manufactured from an aluminum material. The meltable solid may be a personal care product. The spring may be an accordion spring and may be configured to rotatably fix the lift to the base while allowing for a variable distance between the lift and the base.

Aspects of this document relate to an applicator comprising a body extending between a top end and a bottom end, the body having a threaded inner surface, wherein an interior volume of the body is configured to hold a meltable solid, a cap configured to couple with the top end of the body and enclose the interior volume, a base rotatably coupled to the bottom end of the body, and a lift positioned within the body, the lift having a threaded outer surface configured to engage with the threaded inner surface of the body, wherein the lift is rotatably fixed to the base such that when the base is rotated with respect to the body, the lift rotates with the base, wherein, when the base is rotated in a first direction, the threaded outer surface of the lift engages with the threaded inner surface of the body to raise the lift with respect to the body and when the base is rotated in a second direction opposite the first direction, the threaded outer surface of the lift engages with the threaded inner surface of the body to lower the lift with respect to the body.

Particular embodiments may comprise one or more of the following features. The base may have a top surface with a first anchor extending up from the top surface, wherein the first anchor is configured to provide a secure attachment point to the base. The lift may further have a bottom surface with a second anchor extending down from the bottom surface and configured to provide a secure attachment point to the lift. The lift may be rotatably fixed to the base through a spring with a first end of the spring attached to the first anchor and a second end of the spring attached to the second anchor. The spring may be an accordion spring and may be configured to rotatably fix the lift to the base while allowing for a variable distance between the lift and the base. The cap may be configured to slidably couple with the top end of the body. The base may further have a plurality of clips extending up from the top surface, the plurality of clips configured to engage with the bottom end of the body to rotatably couple the base to the body. The body may be cylindrical. The applicator may be manufactured from an aluminum material. The meltable solid may be a personal care product.

The foregoing and other aspects, features, and advantages will be apparent from the specification, drawings, and the claims.

BRIEF DESCRIPTION OF THE DRAWINGS

Implementations will hereinafter be described in conjunction with the appended drawings, where like designations denote like elements, and.

Figure 1:
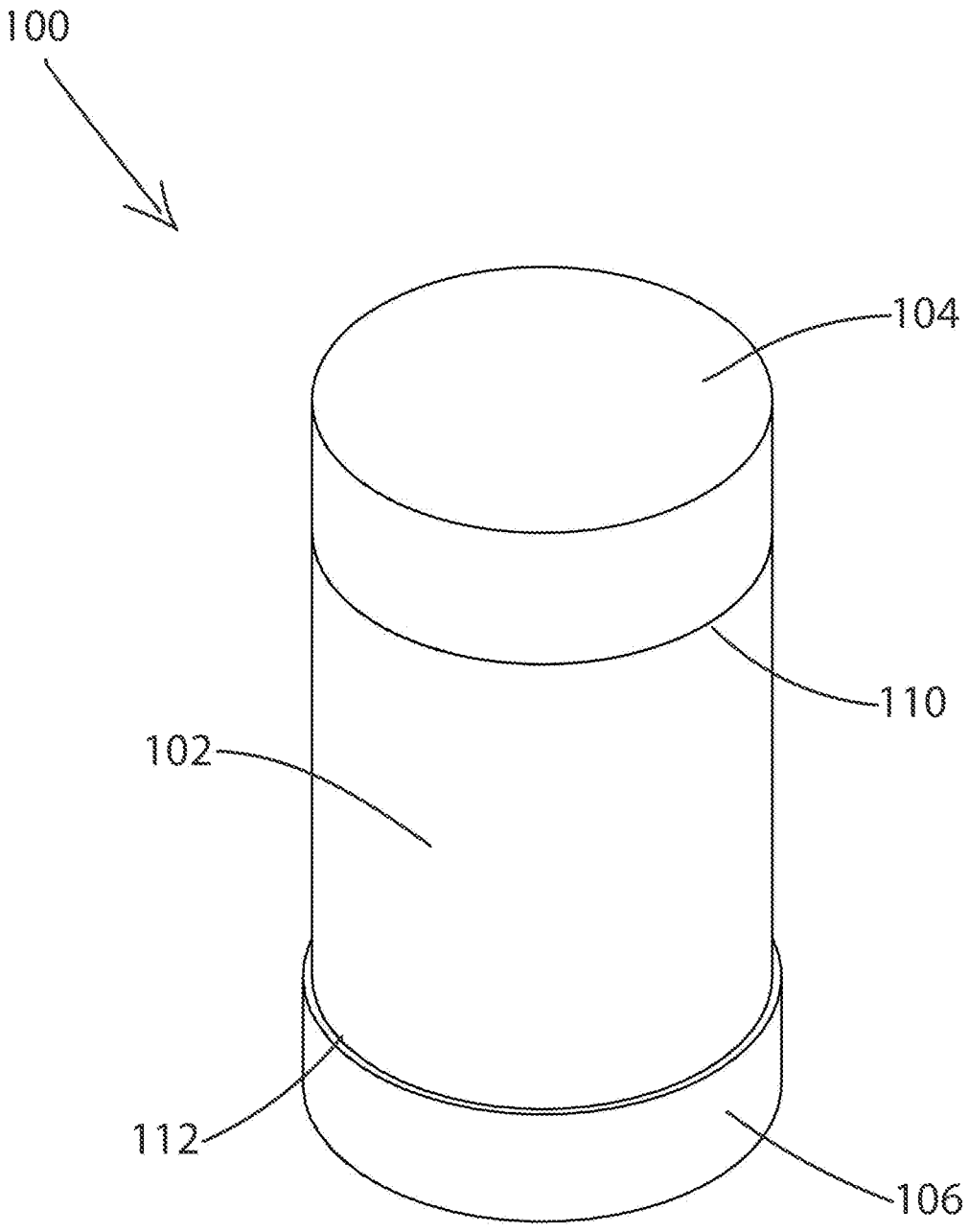
FIG. 1 is a perspective view of a personal care product applicator.
Figure 2:
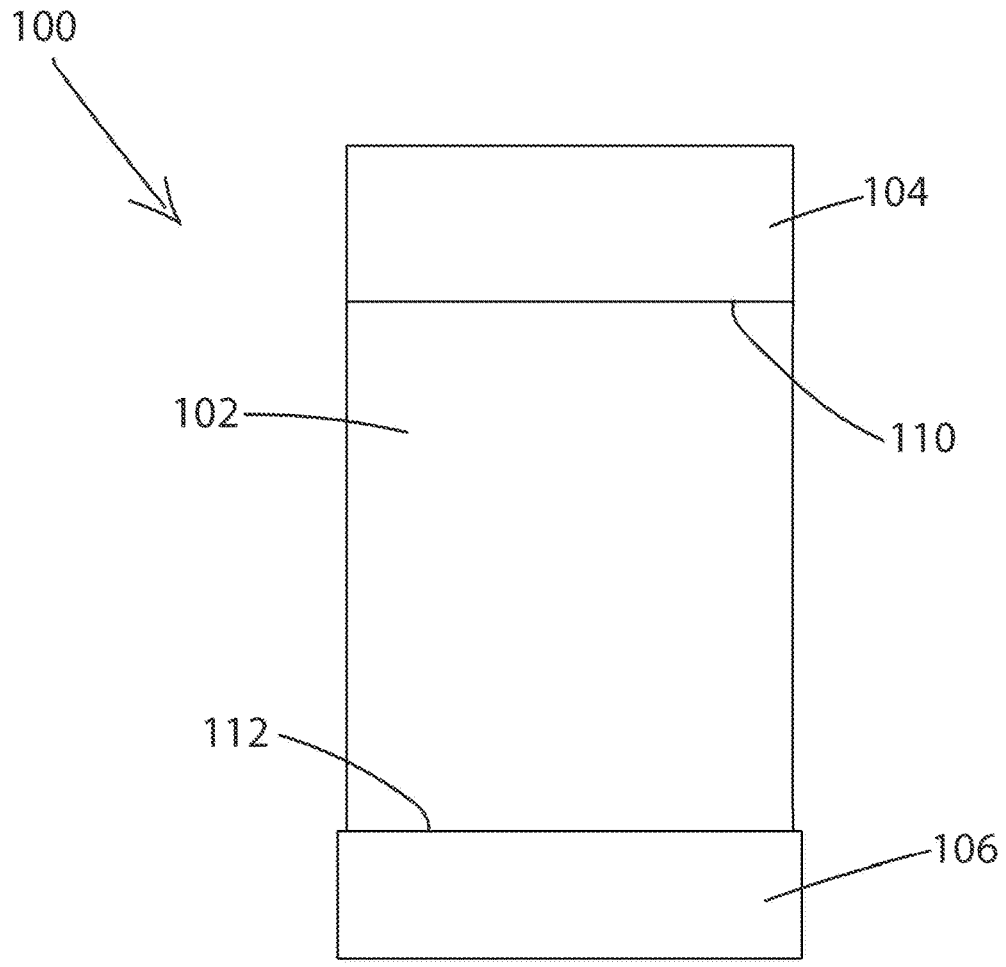
FIG. 2 is a front view of the applicator shown in FIG. 1.
Figure 3:
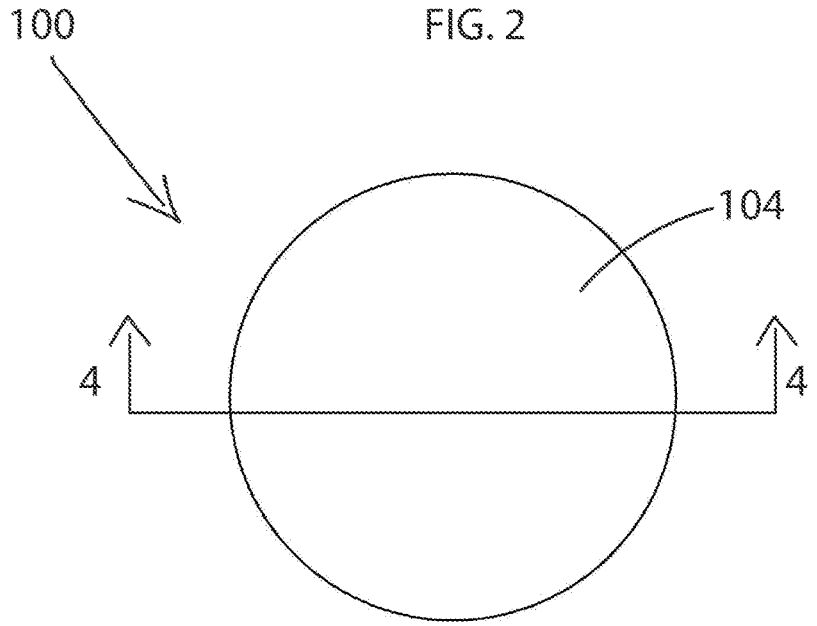
FIG. 3 is a top view of the applicator shown in FIG. 1.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices and technologies to which the disclosed technologies may be applied. The full scope of the technology disclosed herein is not limited to the examples that are described below.

The singular forms "a," "an," and "the" include plural referents unless the context clearly dictates otherwise. Thus, for example, reference to "a step" includes reference to one or more of such steps.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Throughout the description and claims of this specification, the words "comprise" and "contain" and variations of the words, for example "comprising" and "comprises", mean "including but not limited to", and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

More specifically, this disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The present disclosure is related to an applicator 100 that is configured to hold a meltable solid. The applicator 100 may hold a personal care product such as deodorant. Additionally, the applicator 100 may be formed from or manufactured from or with an aluminum material. This makes the applicator 100 more eco-friendly and allows for easier recycling of the applicator 100.

Figure 4:
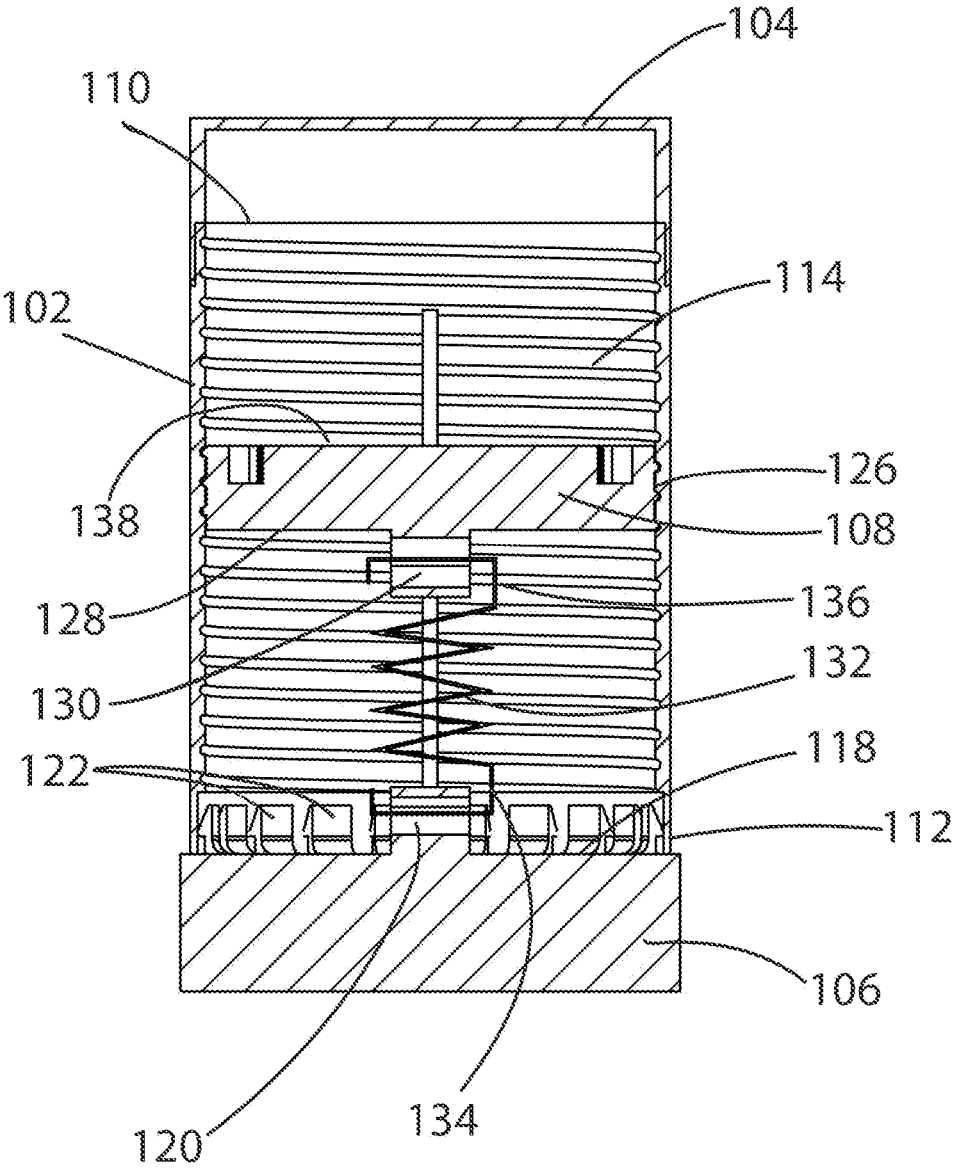
FIG. 4 is a cross-section view of the applicator taken along line 4-4 in FIG. 3.
Figure 5:
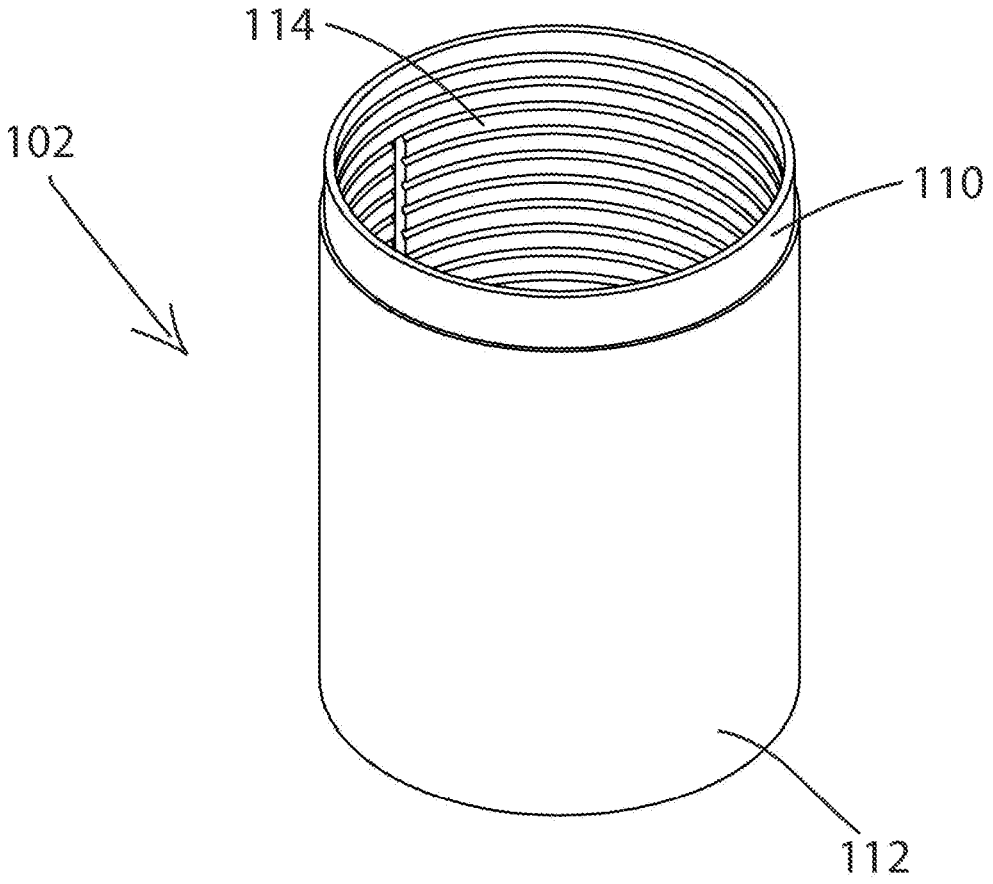
FIG. 5 is a perspective view of the body of the applicator shown in FIG. 1.
Figure 6:
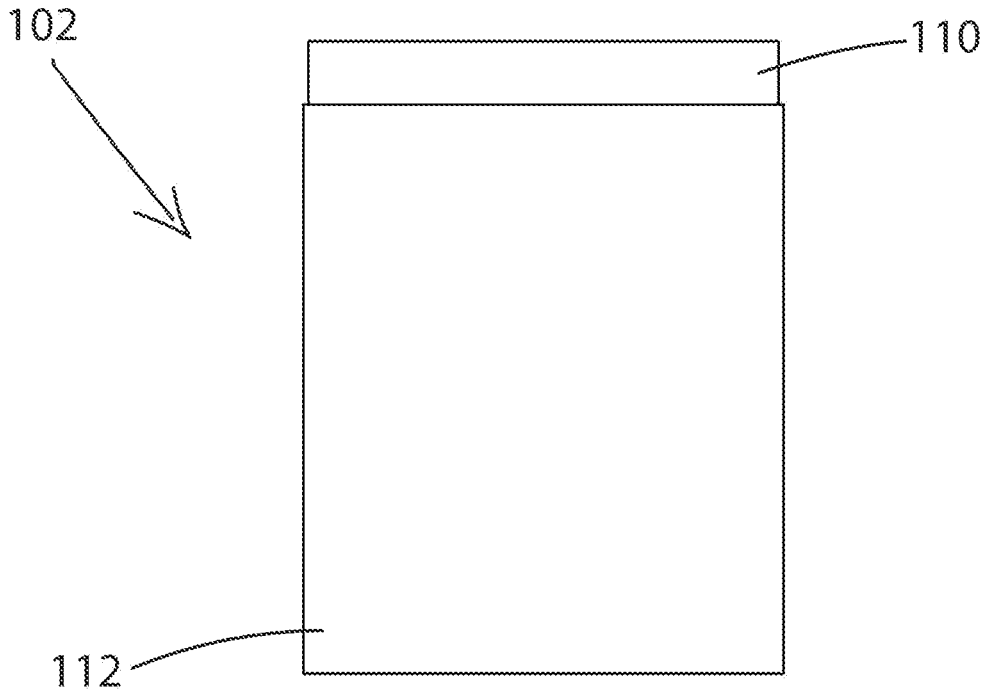
FIG. 6 is a front view of the body shown in FIG. 5.
Figure 7:
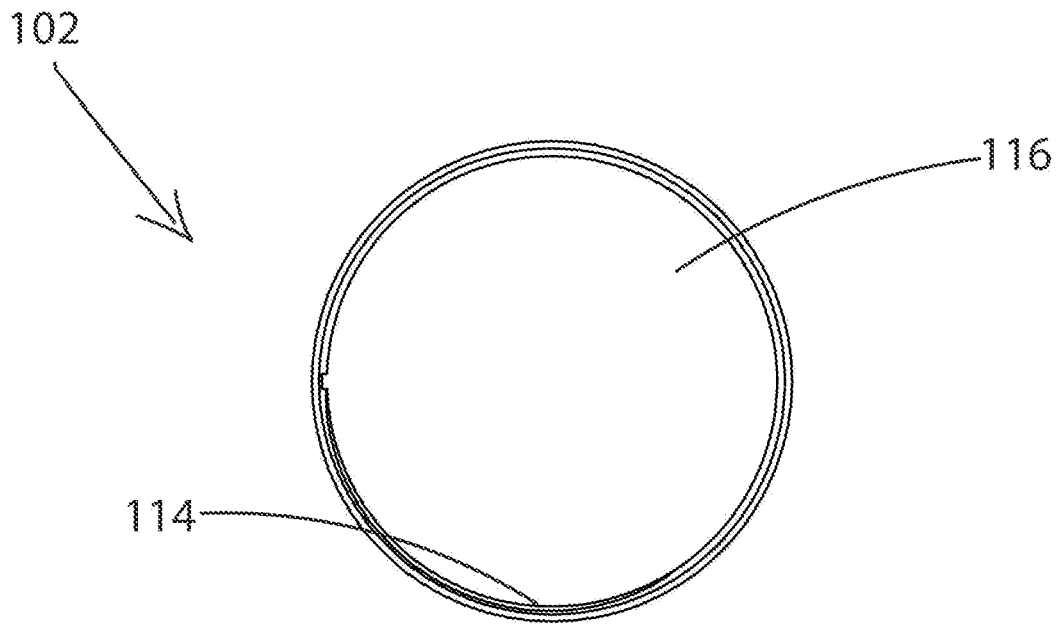
FIG. 7 is a top view of the body shown in FIG. 5.
Figure 8:
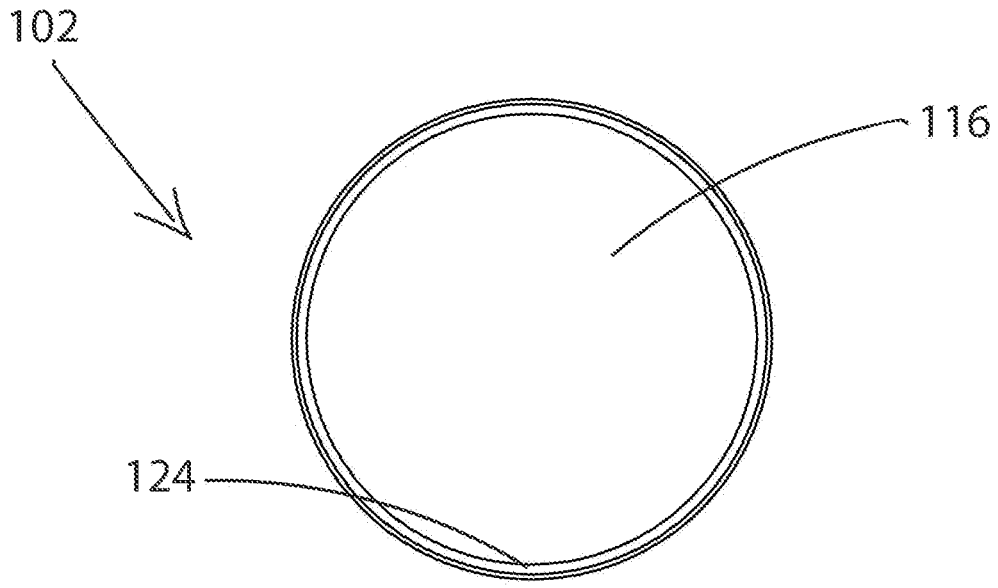
FIG. 8 is a bottom view of the body shown in FIG. 5.

As shown in FIGS. 1-4, the applicator 100 comprises a body 102, a cap 104, a base 106 and a lift 108. As illustrated in FIGS. 4-8, the body 102 is hollow and may extend between a top end 110 and a bottom end 112. Thus, the body 102 may be tubular. Any cross-sectional shape may be implemented in the body 102. For example, the cross section of the body 102 may be circular, making the body cylindrical. In particular embodiments, the cross section of the body 102 may be rectangular, square, oval-shaped, or any other shape. Because the body 102 is hollow and/or tubular, the body 102 has an inner surface 114. The inner surface 114 may be threaded, as shown in FIG. 4-5. An interior volume 116 of the body 102 is configured to hold a meltable solid. In some embodiments, the applicator 100 may be sold empty, and in other embodiments it may be filled with a personal care product such as deodorant, body balm, or any form of personal care or cosmetic product known in the art.

Figure 9:
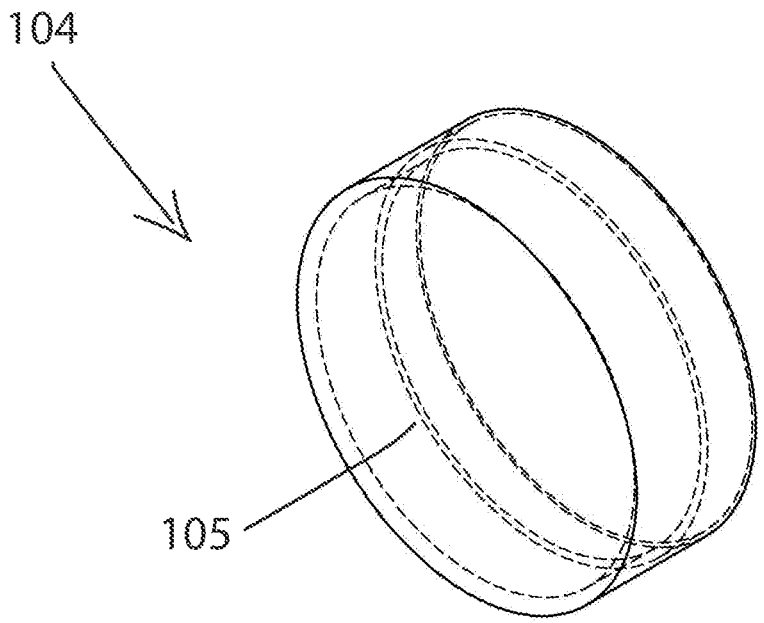
FIG. 9 is a perspective view of the cap of the applicator shown in FIG. 1.
Figure 10:
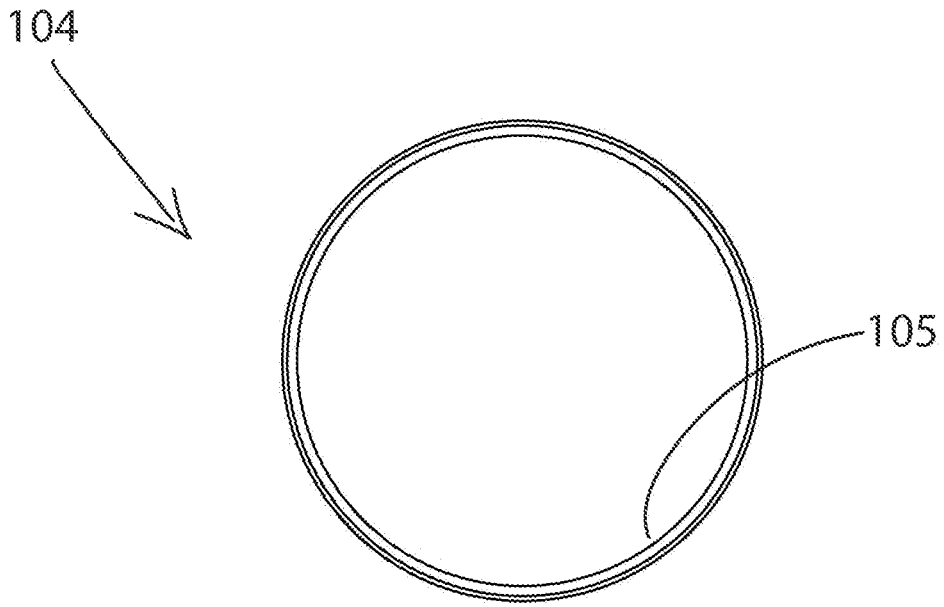
FIG. 10 is a bottom view of the cap shown in FIG. 9.
Figure 11:
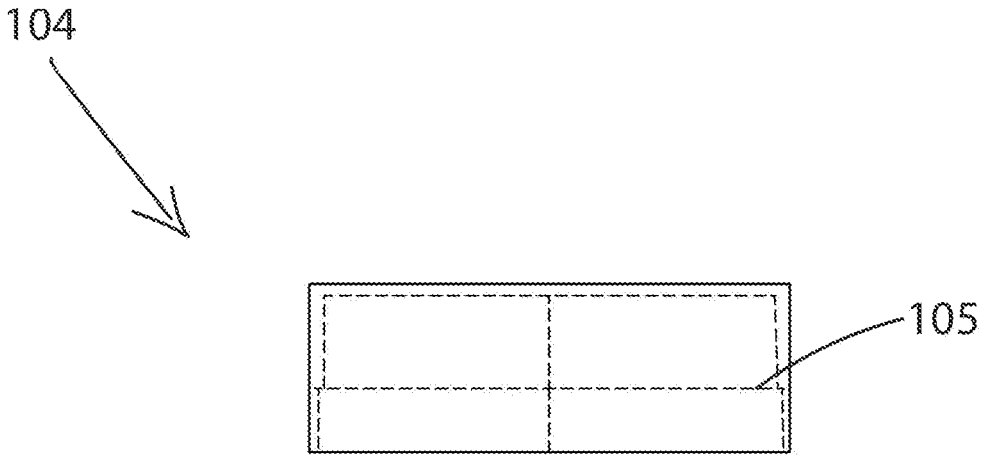
FIG. 11 is a front view of the cap shown in FIG. 9.
Figure 12:
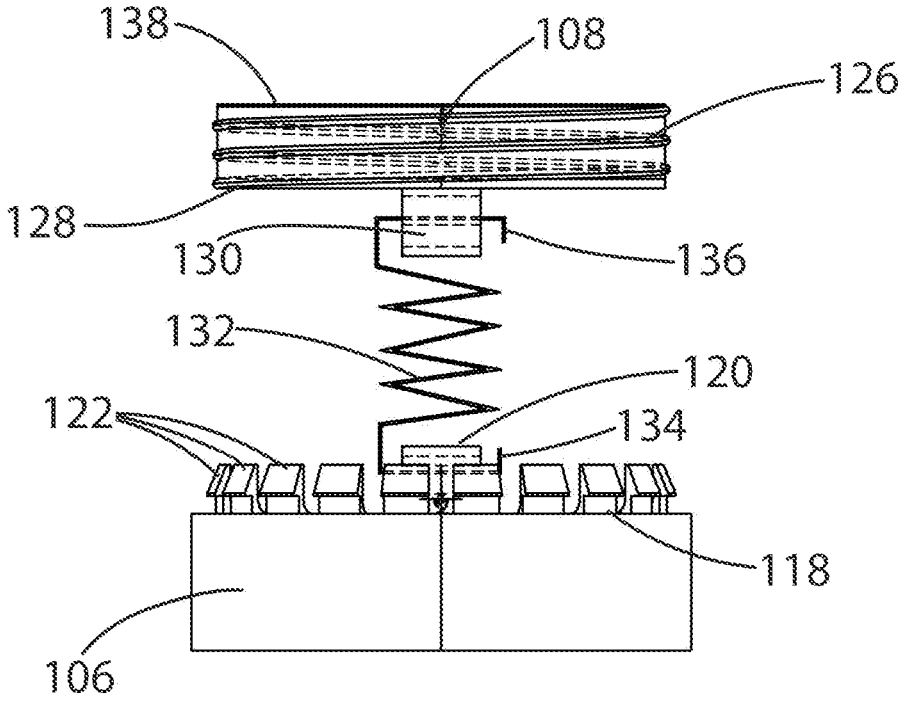
FIG. 12 is a front view of the interior components of the applicator shown in FIG. 1.
Figure 13:
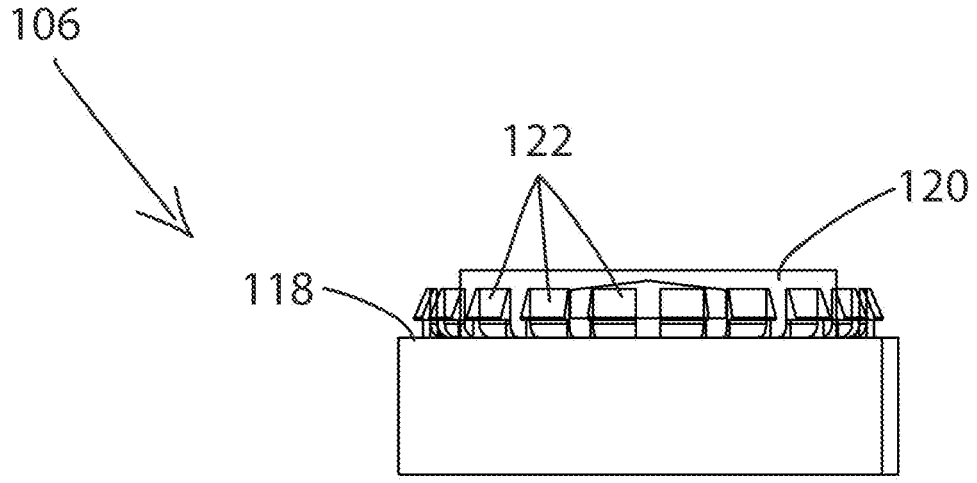
FIG. 13 is a front view of the base of the applicator shown in FIG. 1.
Figure 14:
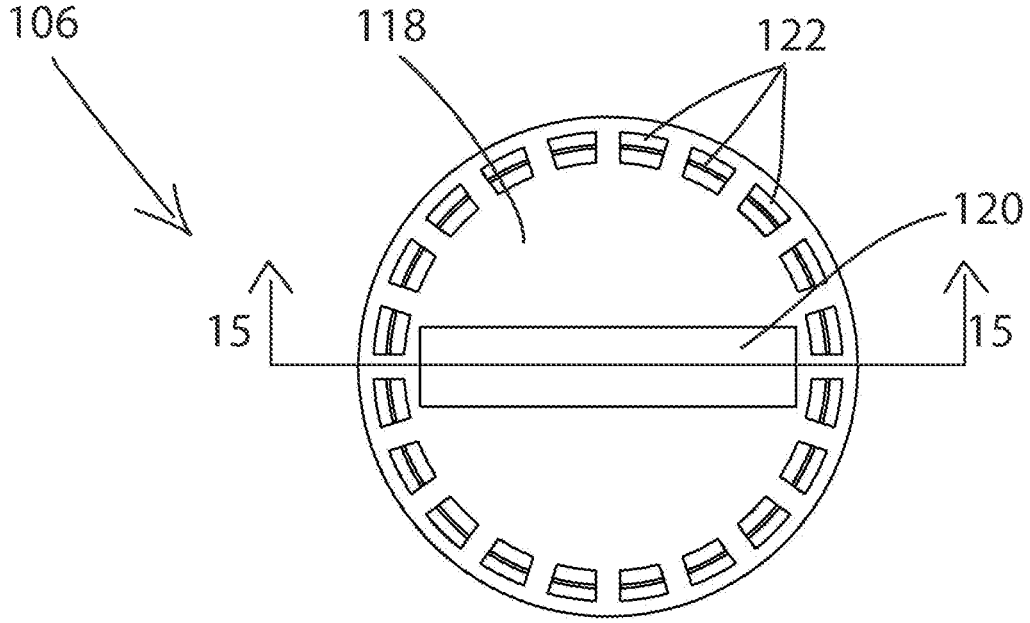
FIG. 14 is a top view of the base shown in FIG. 13.
Figure 15:
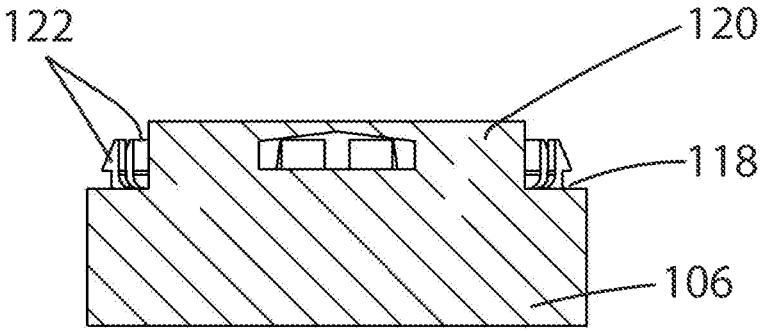
FIG. 15 is a cross-section view of the base taken from line 15-15 in FIG. 14.
Figure 16:
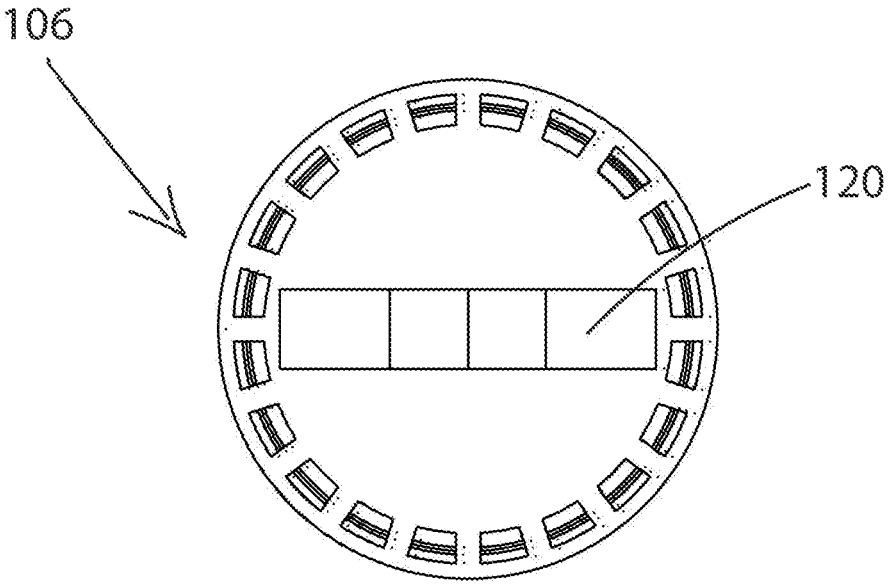
FIG. 16 is a bottom view of the base shown in FIG. 13.
Figure 17:
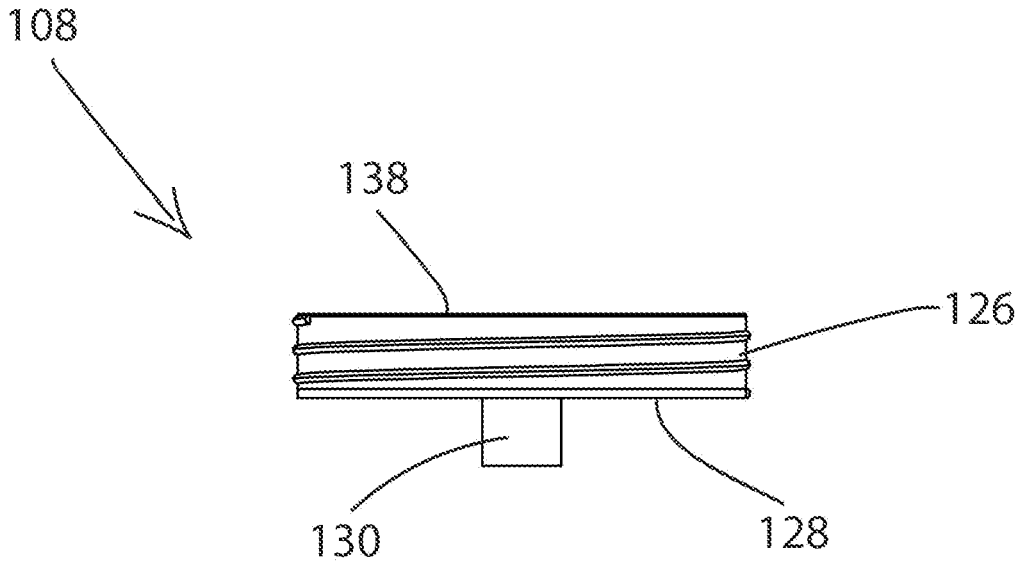
FIG. 17 is a front view of the lift of the applicator shown in FIG. 1.
Figure 18:
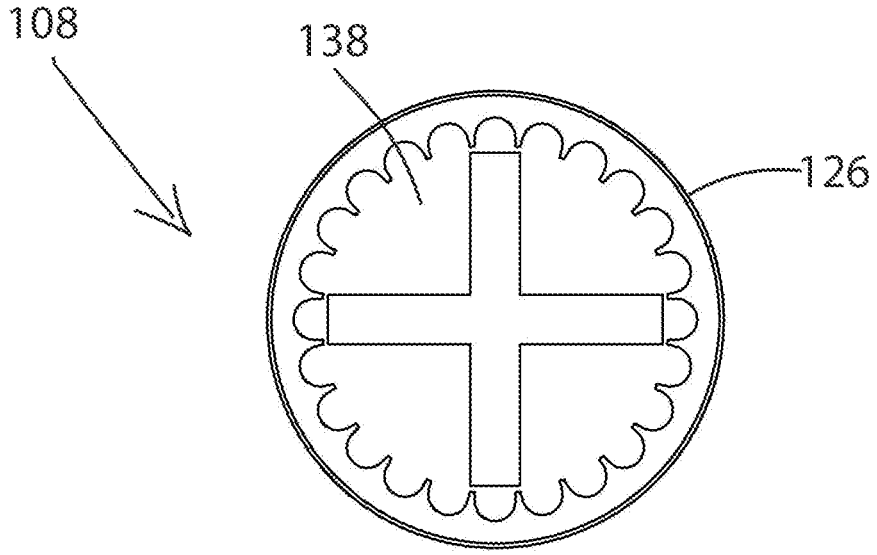
FIG. 18 is a top view of the lift shown in FIG. 17.
Figure 19:
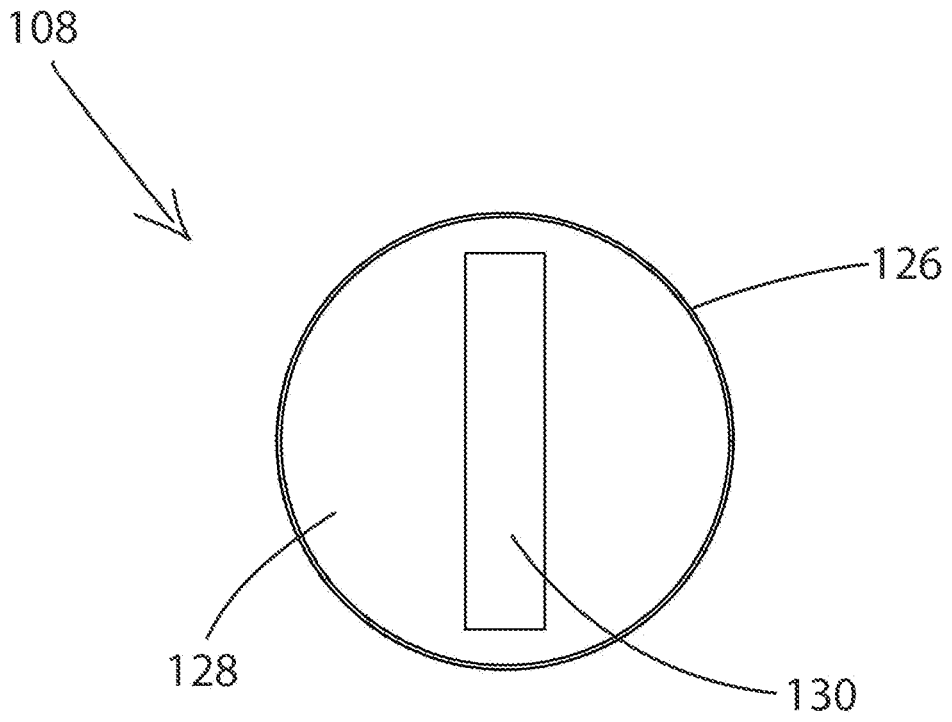
FIG. 19 is a bottom view of the lift shown in FIG. 17.
Figure 20:
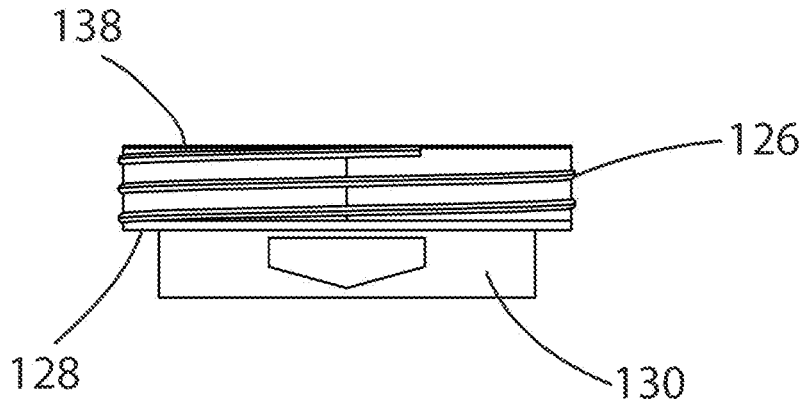
FIG. 20 is a side view of the lift shown in FIG. 17.

Returning to FIG. 4, the cap 104 is configured to slidably couple with the top end 110 of the body 102. In some embodiments, the cap 104 slides around an outside of the body 102. In some embodiments, the cap 104 slides into the interior volume 116 of the body 102. As shown in FIGS. 9-11, the cap 104 may have a shelf 105 that is configured to contact the top end 110 of the body 102 when the cap 104 is inserted onto or into the body 102. When the cap 104 is coupled with the body 102, the cap 104 encloses the interior volume 116 and thus is configured to protect the contents of the applicator 100 from contaminants.

Turning to FIGS. 12-16, the base 106 is coupled to the bottom end 112 of the body 102. In some embodiments, the base 106 is rotatably coupled to the body 102. This allows the base 106 to remain coupled to the body 102 while rotating with respect to the body 102. The base 106 has a top surface 118. The top surface 118 may have a first anchor 120 configured to provide a secure attachment point to the base 106. For example, the first anchor 120 may have a hole extending through the first anchor 120 that allows other components to loop through the hole and thus attach to the first anchor 120. In some embodiments, the first anchor 120 joins to the top surface 118 of the base 106 on both sides of the hole. Alternatively, the first anchor 120 may only join at one point and may form a hook instead of having a hole.

The top surface 118 of the base 106 may also have a plurality of clips 122 extending up from the top surface 118. The clips 122 may be configured to engage with the bottom end 112 of the body 102 to rotatably couple the base 106 to the body 102. In some embodiments, the bottom end 112 of the body 102 includes an annular ridge 124 that is configured to engage with the clips 122 to hold the base 106 to the body 102. Any number of clips 122 may be implemented, and the clips 122 may be arranged in any pattern on the top surface 118 of the base 106. In some embodiments, the clips 122 form a circle and surround the first anchor 120.

The lift 108 is positioned within the body 102, as shown in FIG. 4. Illustrated in more detail in FIGS. 17-20, the lift 108 has a threaded outer surface 126 that is configured to engage with the threaded inner surface 114 of the body 102. This allows the lift 108 to move up and down within the body 102 as the lift 108 rotates within the body 102. For example, when the lift 108 rotates in a first direction, the lift 108 moves up within the body 102 and when the lift 108 rotates in a second direction opposite the first direction, the lift 108 moves down within the body 102. Thus, the lift 108 may be sized to fit within the body 102, with the threaded outer surface 126 in contact with the threaded inner surface 114 of the body 102. In some embodiments, the outer surface 126 of the lift 108 and/or the inner surface 114 of the body 102 may not be threaded, and the up and down movement of the lift 108 may be effectuated in another manner, such as through the use of a central threaded post, telescopic twist engagement, hook/teeth structures, or any other means know to those skilled in the art.

The lift has a bottom surface 128. The bottom surface 128 may have a second anchor 130 extending down from the bottom surface 128. The second anchor 130 may be similar in form and function to the first anchor 120 described above. Thus, the second anchor 130 is configured to provide a secure attachment point to the lift 108. For example, the second anchor 130 may have a hole extending through the second anchor 130 that allows other components to loop through the hole and thus attach to the second anchor 130. In some embodiments, the second anchor 130 joins to the bottom surface 128 of the lift 108 on both sides of the hole. Alternatively, the second anchor 130 may only join at one point and may form a hook instead of having a hole.

The lift also has a top surface 138. The top surface 138 may have a texture formed, engraved, or etched into the top surface 138. The texture may help the top surface 138 to engage with and hold the meltable solid within the body 102 once the meltable solid has solidified. For example, as shown specifically in FIG. 18, the top surface 138 has a cavity in the top surface 138 that is bounded by the plurality of curved surfaces on the outside and the cross at a center of the top surface 138. When the meltable solid is poured into the body 102, it fills the texture on the top surface 138 and then solidifies in that shape, thus allowing the meltable solid to move with the lift 108.

The lift 108 may be rotatably fixed to the base 106. In some embodiments, the lift 108 is rotatably fixed to the base 106 through a spring 132. The spring 132 has a first end 134 and a second end 136. The first end 134 may be attached to the first anchor 120 and the second end 136 may be attached to the second anchor 130. The benefit of using a spring 132 to connect the lift 108 to the base 106 is that the spring 132 can transmit the rotation of the base 106 to the lift 108 while allowing for a variable distance between the base 106 and the lift 108. Thus, when the base 106 is rotated with respect to the body 102, the lift 108 rotates with the base 106 and is able to move up or down within the body 102.

Figure 21:
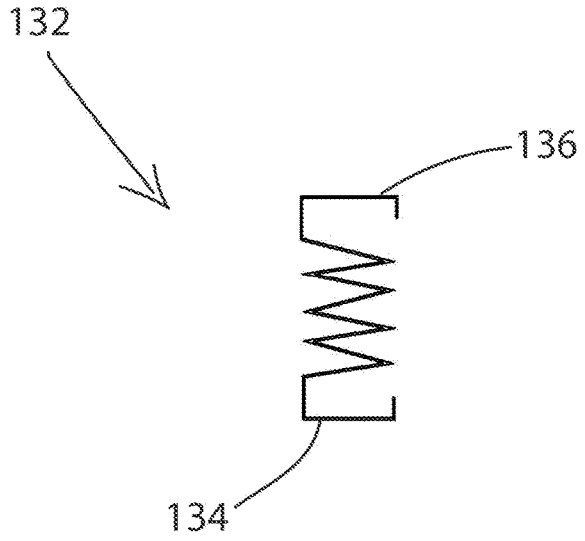
FIG. 21 is a front view of the spring of the applicator shown in FIG. 1.
Figure 22:
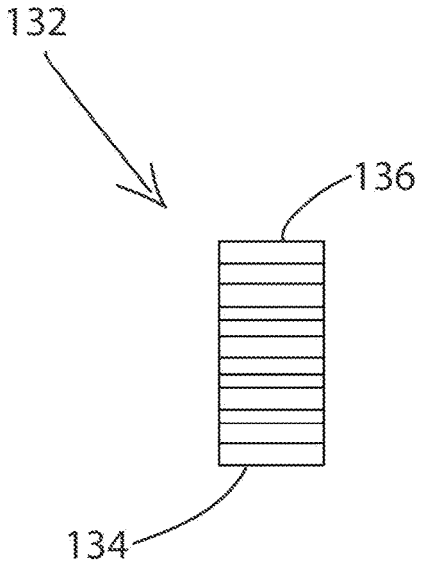
FIG. 22 is a side view of the spring shown in FIG. 21.
Figure 23:
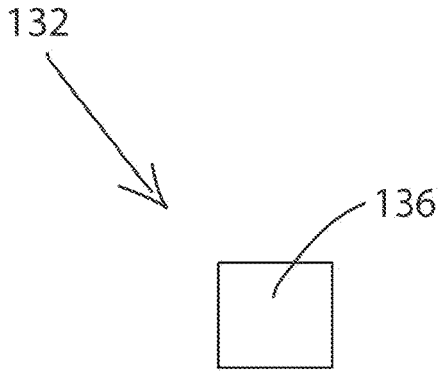
FIG. 23 is a top view of the spring shown in FIG. 21.

In some embodiments, the spring 132 is an accordion spring, as shown in FIGS. 21-23. An accordion spring is typically formed from a flat plate and bent into an accordion shape by alternating the direction of the bend. This increases the torsional rigidity of the spring 132 because of the wider dimension of the plate as compared to a coil spring formed from a wire. As mentioned above, the increased torsional rigidity helps to rotatably fix the lift 108 to the base 106 while allowing for a variable distance between the lift 108 and the base 106.

When the base 106 is rotated in the first direction as discussed above, the threaded outer surface 126 of the lift 108 engages with the threaded inner surface 114 of the body 102 to raise the lift 108 with respect to the body 102. Conversely, when the base 106 is rotated in the second direction as discussed above, the threaded outer surface 126 of the lift 108 engages with the threaded inner surface 114 of the body 102 to lower the lift 108 with respect to the body 102. Thus, the personal care product or other meltable solid within the body 102 can be raised and lowered to dispense more of the product or retract the product into the body 102.

It will be understood that implementations of a personal care product applicator are not limited to the specific assemblies, devices and components disclosed in this document, as virtually any assemblies, devices and components consistent with the intended operation of a personal care product applicator may be used. Accordingly, for example, although particular personal care product applicators, and other assemblies, devices and components are disclosed, such may include any shape, size, style, type, model, version, class, measurement, concentration, material, weight, quantity, and/or the like consistent with the intended operation of personal care product applicators. Implementations are not limited to uses of any specific assemblies, devices and components; provided that the assemblies, devices and components selected are consistent with the intended operation of a personal care product applicator.

Accordingly, the components defining any personal care product applicator may be formed of any of many different types of materials or combinations thereof that can readily be formed into shaped objects provided that the materials selected are consistent with the intended operation of a personal care product applicator. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various personal care product applicators may be manufactured using conventional procedures as added to and improved upon through the procedures described here. Some components defining a personal care product applicator may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling personal care product applicators are not limited to the specific order of steps as disclosed in this document. Any steps or sequence of steps of the assembly of a personal care product applicator indicated herein are given as examples of possible steps or sequence of steps and not as limitations, since various assembly processes and sequences of steps may be used to assemble personal care product applicators.

The implementations of a personal care product applicator described are by way of example or explanation and not by way of limitation. Rather, any description relating to the foregoing is for the exemplary purposes of this disclosure, and implementations may also be used with similar results for a variety of other applications employing a personal care product applicator.

What is claimed is:

1. An applicator comprising:

a hollow, cylindrical body extending between a top end and a bottom end, the body having a threaded inner surface, wherein an interior volume of the body is configured to hold a meltable solid;

a cap configured to slidably couple with the top end of the body and enclose the interior volume;

a base rotatably coupled to the bottom end of the body, the base having a top surface with a first anchor extending up from the top surface and a plurality of clips extending up from the top surface surrounding the first anchor, wherein the first anchor is configured to provide a secure attachment point to the base and the plurality of clips are configured to engage with the bottom end of the body to rotatably couple the base to the body; and a lift positioned within the body, the lift having a threaded outer surface configured to engage with the threaded inner surface of the body, the lift further having a bottom surface with a second anchor extending down from the bottom surface and configured to provide a secure attachment point to the lift, wherein the lift is rotatably fixed to the base through a spring with a first end of the spring attached to the first anchor and a second end of the spring attached to the second anchor, and wherein when the base is rotated with respect to the body, the lift rotates with the base;

wherein, when the base is rotated in a first direction, the threaded outer surface of the lift engages with the threaded inner surface of the body to raise the lift with respect to the body and when the base is rotated in a second direction opposite the first direction, the threaded outer surface of the lift engages with the threaded inner surface of the body to lower the lift with respect to the body.

2. The applicator of claim 1, wherein the applicator is manufactured from an aluminum material.

3. The applicator of claim 1, wherein the meltable solid is a personal care product.

4. The applicator of claim 1, wherein the spring is an accordion spring and is configured to rotatably fix the lift to the base while allowing for a variable distance between the lift and the base.

5. An applicator comprising:

a hollow body extending between a top end and a bottom end, the body having a threaded inner surface, wherein an interior volume of the body is configured to hold a meltable solid;

a cap configured to couple with the top end of the body and enclose the interior volume;

a base rotatably coupled to the bottom end of the body, the base having:

a top surface with a first anchor extending up from the top surface, the first anchor configured to provide a secure attachment point to the base; and a plurality of clips extending up from the top surface and surrounding the first anchor, the plurality of clips configured to engage with the bottom end of the body to rotatably couple the base to the body; and a lift positioned within the body, the lift having a threaded outer surface configured to engage with the threaded inner surface of the body, the lift further having a bottom surface with a second anchor extending down from the bottom surface configured to provide a secure attachment point to the lift, wherein the lift is rotatably fixed to the base through a spring with a first end of the spring attached to the first anchor and a second end of the spring attached to the second anchor, and wherein when the base is rotated with respect to the body, the lift rotates with the base;

wherein, when the base is rotated in a first direction, the threaded outer surface of the lift engages with the threaded inner surface of the body to raise the lift with respect to the body and when the base is rotated in a second direction opposite the first direction, the threaded outer surface of the lift engages with the threaded inner surface of the body to lower the lift with respect to the body.

6. The applicator of claim 5, wherein the cap is configured to slidably couple with the top end of the body.

7. The applicator of claim 5, wherein the applicator is manufactured from an aluminum material.

8. The applicator of claim 5, wherein the meltable solid is a personal care product.

9. The applicator of claim 5, wherein the spring is an accordion spring and is configured to rotatably fix the lift to the base while allowing for a variable distance between the lift and the base.

10. An applicator comprising:

a body extending between a top end and a bottom end, the body having a threaded inner surface, wherein an interior volume of the body is configured to hold a meltable solid;

a cap configured to couple with the top end of the body and enclose the interior volume;

a base rotatably coupled to the bottom end of the body, the base having a plurality of clips extending up from a top surface of the base, the plurality of clips configured to engage with the bottom end of the body to rotatably couple the base to the body; and a lift positioned within the body, the lift having a threaded outer surface configured to engage with the threaded inner surface of the body, wherein the lift is rotatably fixed to the base such that when the base is rotated with respect to the body, the lift rotates with the base;

wherein, when the base is rotated in a first direction, the threaded outer surface of the lift engages with the threaded inner surface of the body to raise the lift with respect to the body and when the base is rotated in a second direction opposite the first direction, the threaded outer surface of the lift engages with the threaded inner surface of the body to lower the lift with respect to the body.

11. The applicator of claim 10, wherein the top surface has a first anchor extending up therefrom, wherein the first anchor is configured to provide a secure attachment point to the base.

12. The applicator of claim 11, the lift further having a bottom surface with a second anchor extending down from the bottom surface and configured to provide a secure attachment point to the lift.

13. The applicator of claim 12, wherein the lift is rotatably fixed to the base through a spring with a first end of the spring attached to the first anchor and a second end of the spring attached to the second anchor.

14. The applicator of claim 13, wherein the spring is an accordion spring and is configured to rotatably fix the lift to the base while allowing for a variable distance between the lift and the base.

15. The applicator of claim 10, wherein the cap is configured to slidably couple with the top end of the body.

16. The applicator of claim 10, wherein the body is cylindrical.

17. The applicator of claim 10, wherein the applicator is manufactured from an aluminum material.

18. The applicator of claim 10, wherein the meltable solid is a personal care product.

* * * * *